US006553952B2

(12) United States Patent
Grau

(10) Patent No.: US 6,553,952 B2
(45) Date of Patent: Apr. 29, 2003

(54) ELECTRICALLY ROTATABLE SHAFT

(75) Inventor: Ulrich Grau, Emskirchen (DE)

(73) Assignee: INA-Schaeffler KG (DE)

( * ) Notice: Subject to any disclaimer, the term of this patent is extended or adjusted under 35 U.S.C. 154(b) by 0 days.

(21) Appl. No.: 10/128,877

(22) Filed: Apr. 24, 2002

(65) Prior Publication Data

US 2002/0157627 A1 Oct. 31, 2002

(30) Foreign Application Priority Data

Apr. 26, 2001 (DE) ..... 101 20 449

(51) Int. Cl.[7] ..... F01L 1/34

(52) U.S. Cl. ..... 123/90.17; 123/90.15; 123/90.16; 123/90.27; 123/90.31; 123/90.6

(58) Field of Search ..... 123/90.15, 90.16, 123/90.17, 90.27, 90.31, 90.6

(56) References Cited

U.S. PATENT DOCUMENTS 4,969,261 A 11/1990 Igarashi ..... 29/888.1
2002/0157625 A1 * 10/2002 Grau
2002/0157626 A1 * 10/2002 Grau

FOREIGN PATENT DOCUMENTS

| | | | | |
|---|---|---|---|---|
| DE | 470032 | | 1/1929 | |
| DE | 3706745 | | 9/1987 | |
| DE | 19642059 | | 4/1997 | |
| DE | 19918398 | | 11/1999 | |
| JP | 59192810 A | * | 11/1984 | ..... F01L/01/12 |
| WO | WO 173312 A1 | * | 10/2001 | ..... F16D/65/21 |

* cited by examiner

*Primary Examiner*—Thomas Denion
*Assistant Examiner*—Ching Chang
(74) *Attorney, Agent, or Firm*—Muserlian, Lucas and Mercanti

(57) ABSTRACT

The invention concerns an electrically rotatable adjusting shaft (1) of a fully variable mechanical valve train of an internal combustion engine, said adjusting shaft comprising an adjusting cam. A rapid and exact rotation of the adjusting shaft (1) and the load regulation of the internal combustion engine depending thereon is achieved by the fact that an actuator (3) for rotating the adjusting shaft (1) comprises an adjusting lever (4) that is connected rotationally fast to the adjusting shaft (1), and the free end of the adjusting lever (4) can be loaded by a cam plate (6) that is driven by an electromotor (7).

10 Claims, 1 Drawing Sheet

ELECTRICALLY ROTATABLE SHAFT

FIELD OF THE INVENTION

The invention concerns an electrically rotatable adjusting shaft of a fully variable mechanical valve train of an internal combustion engine, said shaft comprising an adjusting cam.

BACKGROUND OF THE INVENTION

The advantages of a throttle-free load regulation of Otto engines by means of fully variable inlet valve controls are known. By the omission of throttles, it is possible to exclude throttling losses that otherwise occur over a large range of load conditions of the internal combustion engine. This has a positive effect on fuel consumption and on the engine torque.

In variable mechanical valve trains, the stroke adjustment of the inlet gas exchange valves should be as spontaneous and exact as possible and should be effected at a high speed of adjustment. The adjusting mechanism is usually an adjusting shaft having locking curves or eccentrics.

Depending on the system used and the structural configuration, considerable moments of actuation are required for setting the desired valve stroke and the corresponding rotation of the adjusting shaft. These moments of actuation result from the reaction forces of the valve train that act on the adjusting shaft. For adjustment in a direction for obtaining a larger stroke, the adjusting shaft must be moved against the reaction forces of the valve train and, due to the oscillating movement of the gas exchange valves, this is accompanied by strongly pulsating torques.

To achieve an optimum operation of the valve train, a lash-free and extremely rigid support of the moments of the adjusting shaft is required. This support governs the positioning precision and the operation of a fully variable valve train as also the adjustability of an internal combustion engine equipped with such a system. The time for adjusting from a minimum to a maximum stroke should be less than 300 milliseconds.

The power requirement of the electric drive of the adjusting shaft should not put a too heavy load on the vehicle network. Therefore, small, high-speed electromotors combined with gearboxes having high transmission ratios are desirable.

One conceivable solution is to use worm drives. These, however, have a poor efficiency and are susceptible to wear that in its turn causes lash. In addition, worm drives have a limited range of transmission. It is also conceivable to use hydraulic adjusters similar to camshaft adjusters configured as vane-type adjusting devices or as coarse-thread adjusters. Their operation, however, depends to a large extent on the lubricating oil pressure which, in its turn, depends on the temperature of the lubricating oil and on the engine being actually in operation. Their adjusting dynamics and rigidity are low.

A further solution may be rotary drives but these have a low efficiency and a great amount of rotational lash.

OBJECTS OF THE INVENTION

It is an object of the invention to provide a compact actuator for the adjusting shaft of a fully variable mechanical valve train of an internal combustion engine, which actuator should have the highest possible rigidity and possess characteristics of low lash and low friction.

This and other objects and advantages of the invention will become obvious from the following detailed description.

SUMMARY OF THE INVENTION

The invention achieves the above objects by the fact that an actuator for rotating the adjusting shaft comprises an adjusting lever that is connected rotationally fast to the adjusting shaft, and a free end of the adjusting lever can be loaded by a cam plate that is driven by an electromotor. The connections between the adjusting lever and the adjusting shaft, between the adjusting shaft and the cam plate and between the cam plate and the electromotor are substantially free of lash and very rigid. This results in a high precision in the positioning of the rotating shaft and thus also in the adjustment of the inlet valve stroke.

In an advantageous embodiment of the invention, a roller preferably mounted in rolling bearings is arranged on the free end of the adjusting lever, which roller can roll on the cam plate, if necessary under spring bias, or in a gate of the cam plate. The rolling-bearing mounted roller assures low friction between the adjusting lever and the cam plate. When an alternating torque is applied to the adjusting shaft due to the kinematics of the valve train, the adjusting lever must be force-guided on the cam plate. This can be achieved through a gate or through an appropriate biasing of the adjusting lever by a spring.

Advantageously, the contour of the cam plate and of its gate, has a varying slope. Due to the configuration of the cam plate with a varying slope, a controlled variation of the transmission ratio can be realized as a function of its adjusting position. In this way, for example in the lower valve stroke region (the part-load region of the internal combustion engine), a high precision of adjustment and thus a fine load regulation can be achieved. On the other hand, the maximum torques applied to the adjusting shaft at full valve stroke can be distinctly reduced by a controlled reduction of the slope of the cam plate. By this, the torque of the electromotor as well, and thus the load on the vehicle network can be maintained at a low level and, in spite of this, a high speed of adjustment can be achieved.

Advantageously, the cam plate is driven by the electromotor through a gearbox. A gearbox in the drive of the cam plate permits the use of a high-speed electromotor with a relatively low torque. In the case of a direct drive, the electromotor would have to have a correspondingly high torque.

According to a further advantageous feature of the invention, the cam plate is made in one piece with an electromotor shaft or with a gearbox output shaft. As a result, it is possible to dispense with a coupling between the electromotor or the gearbox and the cam plate, so that a simple, compact actuator with high rigidity and freedom from lash is obtained.

Advantageously, the actuator comprises a fixed bearing that is configured as a deep groove ball bearing, an angular contact ball bearing or a four point bearing, and a movable bearing that is preferably configured as a needle roller bearing.

Because the electromotor is arranged parallel to the adjusting shaft and perpendicular to the plane of the adjusting lever, a particularly compact actuator is obtained.

Due to the fact that the transmission ratio between the electromotor and the adjusting shaft is determined by the transmission ratio of the gearbox, the slope of the contour of the cam plate and the length of the adjusting lever, a large range of transmission ratios can be realized in a single stage. The degrees of efficiency that can be achieved thereby are distinctly higher than with multi-stage rotary drives or with worm drives. Additionally, lash in the drive is only slight and the positioning precision is therefore high.

A further advantage of the invention is that the actuator can be installed in any longitudinal and any angular position on the adjusting shaft. In this way, the position of the actuator can be adapted to the installation and space conditions of the internal combustion engine.

Further features of the invention are disclosed in the following description and in the appended drawings which show a schematic representation of one example of embodiment of the invention.

DETAILED DESCRIPTION OF THE DRAWINGS

Figure 1:
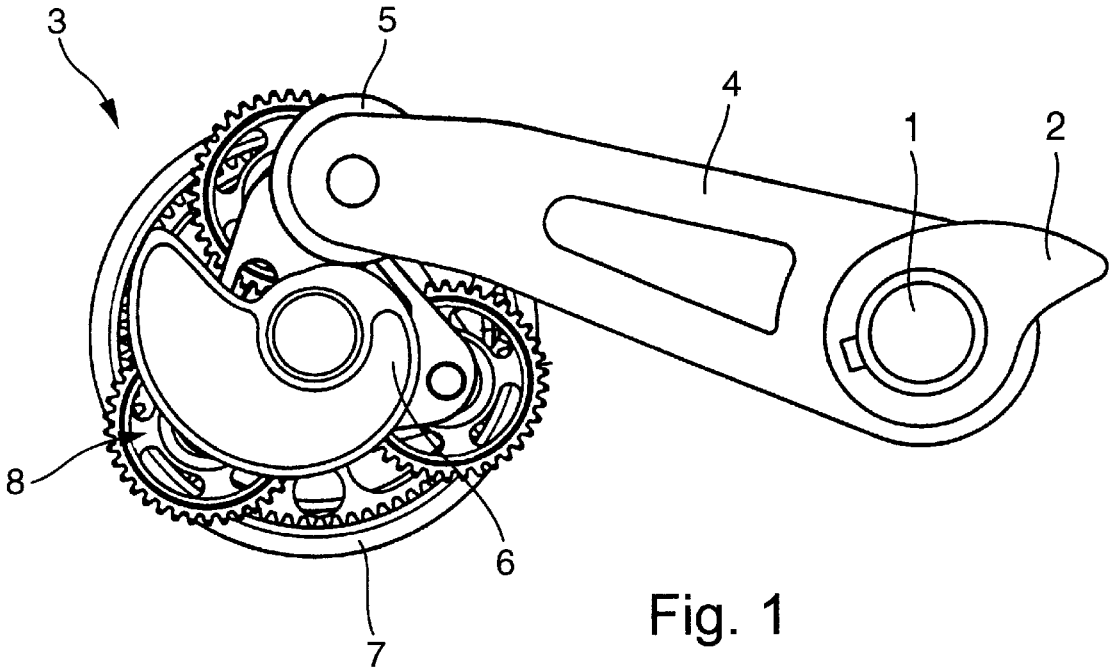
FIG. 1 shows an adjusting shaft in cross-section, with an adjusting lever in a position for a maximum valve stroke.
Figure 2:
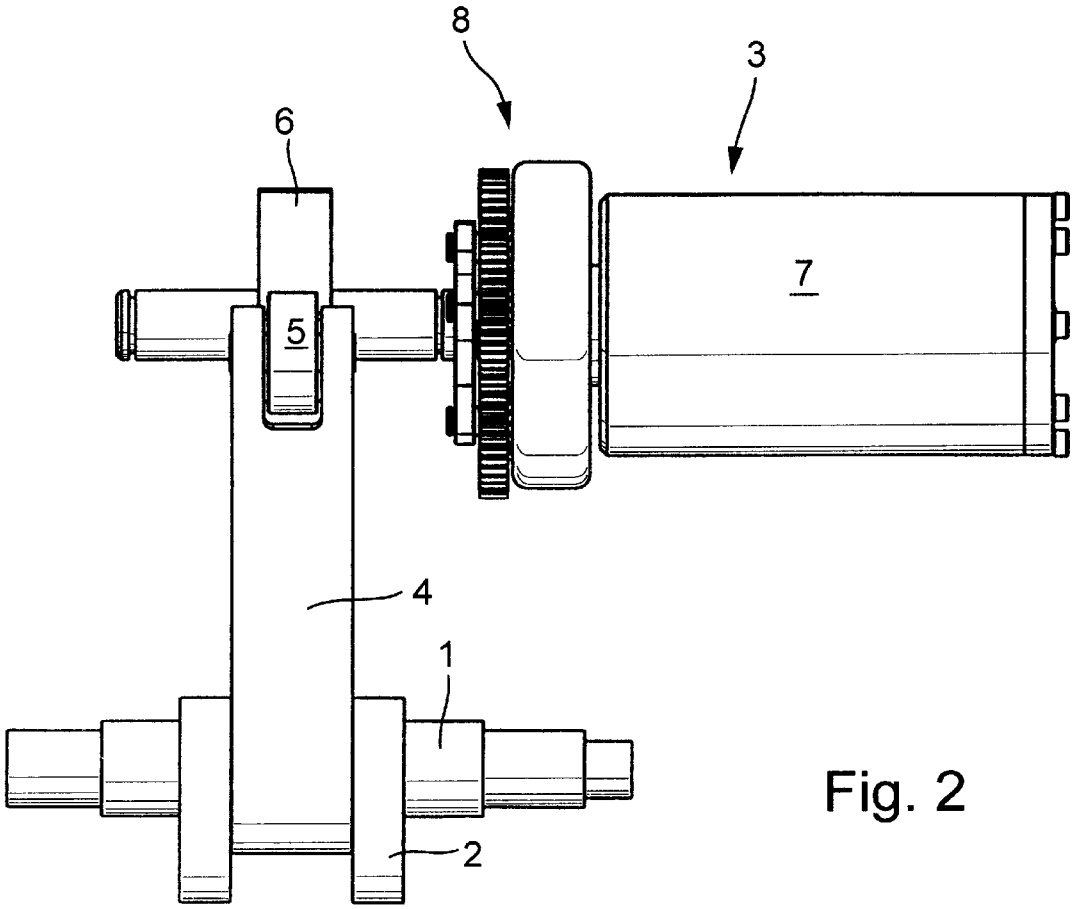
FIG. 2 is a top view of the adjusting shaft and an actuator.

FIG. 1 discloses an adjusting shaft 1 with an adjusting cam 2 for a fully variable mechanical valve train, not shown, of an Otto engine, and an actuator 3 for the adjusting shaft 1. The adjusting shaft 1 is connected rotationally together with an adjusting lever 4 on whose free end a rolling-bearing mounted roller 5 is arranged. The roller 5 scans the contour of a cam plate 6 which is driven by an electromotor 7 through a gearbox 8. The position of the adjusting shaft 1 depends directly on the position of the cam plate 6.

The contour of the cam plate 6 has a varying slope. This enables the transmission ratio between the electromotor 7 and the adjusting shaft 1 to be configured variably along the contour of the cam plate 6. In this way, for example, a fine part-load regulation and an effortless full-load adjustment is possible. This further permits a distinctly smaller dimensioning of the drive of the actuator 3 in spite of which, a high speed of adjustment is guaranteed. The transmission ratio of the actuator 3 also depends on that of the gearbox 8 and on the length of the adjusting lever 4.

The cam plate 6 is driven by the electromotor 7 through a gearbox 8. This enables a high-speed electromotor 7 of small overall dimensions to be used that puts only a small load on the vehicle network.

The cam plate is firmly connected, without a coupling, to the output shaft of the motor-gearbox assembly. This results in a simple and compact actuator 3 with high rigidity and freedom from lash.

The actuator 3 is disposed parallel to the adjusting shaft 1 and can be installed at any point thereon and in any relative angular position. This enables a flexible adaptation to the space and installation conditions of the internal combustion engine.

What is claimed is:

1. An electrically rotatable adjusting shaft of a fully variable mechanical valve train of an internal combustion engine, said shaft comprising an adjusting cam, wherein an actuator for rotating the adjusting shaft comprises an adjusting lever that is connected rotationally together with the adjusting shaft, and a free end of the adjusting lever can be loaded by a cam plate that is driven by an electromotor.

2. An electrically driven adjusting shaft of claim 1, wherein a roller mounted in rolling bearings is arranged on the free end of the adjusting lever, and said roller can roll on the cam plate, if necessary under spring bias, or in a gate of the cam plate.

3. An electrically driven adjusting shaft of claim 2, wherein a contour of the cam plate and a contour of the gate has a varying slope.

4. An electrically driven adjusting shaft of claim 3, wherein the cam plate is driven by the electromotor through a gearbox.

5. An electrically driven adjusting shaft of claim 4, wherein the cam plate is made in one piece with one of an electromotor shaft and a gearbox output shaft.

6. An electrically driven adjusting shaft of claim 5, wherein the actuator comprises a fixed bearing and a movable bearing.

7. An electrically driven adjusting shaft of claim 6, wherein the fixed bearing is configured as one of a deep groove ball bearing, an angular contact ball bearing and a four point bearing, while the movable bearing is configured as a needle roller bearing.

8. An electrically driven adjusting shaft of claim 6, wherein the electromotor is arranged parallel to the adjusting shaft and perpendicular to a plane of the adjusting lever.

9. An electrically driven adjusting shaft of claim 8, wherein a transmission ratio between the electromotor and the adjusting shaft is determined by a transmission ratio of the gearbox, the slope of the contour of the cam plate and a length of the adjusting lever.

10. An electrically driven adjusting shaft of claim 9, wherein the actuator can be installed in any longitudinal and any angular position on the adjusting shaft.

* * * * *